US010759718B2

(12) United States Patent
Tang et al.

(10) Patent No.: US 10,759,718 B2
(45) Date of Patent: Sep. 1, 2020

(54) METHOD FOR CONTINUOUSLY PRODUCING EMULSION EXPLOSIVE BY EMULSIFICATION AND SENSITIZATION IN A STATIC STATE WITHOUT A LOADING PUMP

(71) Applicant: SHIJIAZHUANG SUCCESS MACHINERY ELECTRICAL CO., LTD., Shijiazhuang, Hebei (CN)

(72) Inventors: Qiuming Tang, Shijiazhuang (CN); Ziqing Guo, Shijiazhuang (CN); Mushen Wang, Shijiazhuang (CN); Aijun Zhang, Shijiazhuang (CN)

(73) Assignee: SHIJIAZHUANG SUCCESS MACHINERY ELECTRICAL CO., LTD, Shijiazhuang (CN)

( * ) Notice: Subject to any disclaimer, the term of this patent is extended or adjusted under 35 U.S.C. 154(b) by 384 days.

(21) Appl. No.: 15/322,289

(22) PCT Filed: Jun. 25, 2014

(86) PCT No.: PCT/CN2014/080735
§ 371 (c)(1),
(2) Date: Dec. 27, 2016

(87) PCT Pub. No.: WO2015/196390
PCT Pub. Date: Dec. 30, 2015

(65) Prior Publication Data
US 2017/0129824 A1 May 11, 2017

(51) Int. Cl.
*C06B 23/02* (2006.01)
*C06B 21/00* (2006.01)
(Continued)

(52) U.S. Cl.
CPC ..... *C06B 21/0008* (2013.01); *C06B 23/002* (2013.01); *C06B 47/145* (2013.01)

(58) Field of Classification Search
CPC ..... C06B 23/02
See application file for complete search history.

(56) References Cited

U.S. PATENT DOCUMENTS 4,491,489 A 1/1985 Ellis et al.
5,346,564 A 9/1994 Vance et al.

FOREIGN PATENT DOCUMENTS

CN 102850149 A 1/2013
CN 103304348 A 9/2013
(Continued)

OTHER PUBLICATIONS

Oct. 17, 2016 Office Action issued in Chinese Patent Application No. 201410291348.
(Continued)

*Primary Examiner* — Aileen B Felton
(74) *Attorney, Agent, or Firm* — Oliff PLC

(57) ABSTRACT

A method continuously produces emulsion explosive by emulsification and sensitization in a static state without a loading pump. After the water phase and oil phase enters a static emulsifier for emulsification, the emulsion enters a static sensitization device; the sensitizer enters the static sensitization device through the sensitizer charging inlet and mixes with the emulsion in the static sensitization device. After emulsification and sensitization, the sensitized explosive directly enters an injection pipe for encapsulation. By adopting the static emulsifier and sensitization device, the explosive material storage amount is greatly reduced, and mechanical stirring and shearing for emulsification is avoided. Meanwhile, mechanical mixing for sensitization is omitted and replaced with full-static high-temperature sensitization, and the safety of sensitization is improved. The loading pump is omitted, and the sensitized emulsion directly enters the injection pipe, thus the risk points in the
(Continued)

production process and the online explosive material storage amount are reduced.

8 Claims, 2 Drawing Sheets

(51) Int. Cl.
*C06B 23/00* (2006.01)
*C06B 47/14* (2006.01)

(56) References Cited

FOREIGN PATENT DOCUMENTS

| | | | |
|---|---|---|---|
| CN | 103664424 | A | 3/2014 |
| CN | 203598760 | U | 5/2014 |
| CN | 104109057 | A | 10/2014 |

OTHER PUBLICATIONS

Apr. 21, 2016 Office Action issued in Chinese Patent Application No. 201410291348.
Aug. 25, 2015 Office Action issued in Chinese Patent Application No. 201410291348.
Feb. 2, 2015 International Search Report issued in Patent Application No. PCT/CN2014/080735.
Feb. 2, 2015 Written Opinion issued in Patent Application No. PCT/CN2014/080735.
Dec. 20, 2017, Supplementary European Search Report issued in European Patent Application No. 14895829.
Jul. 21, 2017, Australian Office Action issued in Patent Application No. 2014-399172.

METHOD FOR CONTINUOUSLY PRODUCING EMULSION EXPLOSIVE BY EMULSIFICATION AND SENSITIZATION IN A STATIC STATE WITHOUT A LOADING PUMP

TECHNICAL FIELD

The present invention relates to the field of producing emulsion explosive, and more particularly, relates to a method for continuously producing emulsion explosive by emulsification and sensitization in a static state without a loading pump.

BACKGROUND OF THE INVENTION

In recent years, many explosions happened to emulsion explosive production lines, which are related to the mechanical movement of the production equipment, therefore, it is of great significance to work on the development of the full-static emulsification and sensitization second-generation emulsion explosive production line, which replaces dynamic emulsification with static dispersion, replaces dynamic sensitization with static dispersion and removes the loading pump. In order to largely increase the intrinsic safety level and to reduce and even avoid explosion, replacing the backward traditional first-generation production line which has obvious potential safety hazards with the second-generation emulsion explosive production line is of great significance.

SUMMARY OF THE INVENTION

The present invention is directed to a method for continuously producing emulsion explosive by emulsification and sensitization in a static state without a loading pump, to achieve intrinsic safety during the manufacturing of emulsion explosive.

The present invention is implemented through the following technical solution (please refer to FIG. 1).

A method for continuously producing emulsion explosive by emulsification and sensitization in a static state without a loading pump: during emulsification and sensitization, a continuous producing process of static emulsification and static sensitization is used, wherein the static emulsifier and the static sensitization device are made up with at least one of the following: a static mixer, an orifice plate, a jet flow device and a Venturi nozzle; the emulsifier and sensitization device is directly connected to an injection pipe, after emulsification and sensitization, the sensitized explosive directly enters the encapsulation process for encapsulation.

The static emulsifier includes an oil phase inlet, a water phase inlet, a shell and cores, the shell has diverging ports on its inner wall, and each of the cores comprises an injector hole and an orifice plate. Each of the cores corresponds to one of the diverging ports where water phase flows into the corresponding core. The injector hole is located on a tube wall of the core and the orifice plate is located at a rear end of the core, water phase flows through the diverging port and then enters the core through the injector hole, and after being mixed for emulsification with oil phase entering from the oil phase inlet, the resulting emulsion enters the next core through the orifice plate. The static emulsifier contains equal to or more than three cores, preferably five cores.

The static sensitization device includes a shell, a sensitizer charging inlet, a core and a multi-orifice plate. The static sensitization device has equal to or more than one core, preferably three cores, the way that the static sensitization device carries out sensitization is, after sensitizer goes through the sensitizer charging inlet, the sensitizer enters an emulsion chamber by means of a sensitizer injector hole located on a primary core, the emulsion is mixed with the sensitizer when going through a primary multi-orifice plate, and then is mixed to uniformity by going through a second multi-orifice plate and a third multi-orifice plate. The orifices of the multi-orifice plate of the static sensitization device are round, square, cone and/or petal shaped.

The static emulsification and static sensitization can also be carried out by static coarse emulsification, static sensitization and static fine emulsification in sequence, wherein the static sensitization and the static fine emulsification utilize the same device.

The oil phase from the oil tank enters the primary coarse emulsion mixer through the oil pump at its full ratio of the explosive; the water phase from the water tank enters the multi-stage coarse emulsion mixers for multiple times after multi-stage diverging at its respective ratios of the explosive, and finally, emulsification is completed through the last stage of coarse emulsion mixers. After emulsification, the emulsion matrix enters the static sensitization device while the sensitizer enters the static sensitization device at the same time to complete sensitization. Then the produced explosive enters an injection pipe. The injection pipe is wrapped in a cylindrical film and the uniform filling of emulsion explosive into the cylindrical film is carried out by the safe raw material pump rather than the dangerous colloid pump or explosive pump. The well-filled explosive material rolls are sealed and cooled down in cooling water. After the explosive is cooled, it is transported by a conveying belt and boxed, and then it is stored in a warehouse.

The present invention does not need mechanical stirring, shearing or a colloid/explosive pumping device. The water phase is mixed with the oil phase for multiple times through the multi-stage coarse emulsion mixers by controlling and adjusting of the flow streams. The oil phase can be sufficiently mixed each time with a small amount of water phase, and after multiple times of water phase addition, the uniform mixing of all the oil phase with the water phase under low-pressure condition is finally achieved, and the emulsion matrix with a particle size of about 1 micron is obtained. The equipment of the present method mixes the required proportion of water phase with the oil phase for multiple times, which replaces the traditional one-time mixing with multiple times of mixing, this greatly reduces the explosive material storage amount, and also mechanical stirring and shearing for emulsification is avoided. Meanwhile, mechanical mixing for sensitization is omitted and replaced with full-static high-temperature sensitization, and the safety of sensitization is improved. In this way, the loading pump of a traditional production line is omitted, and the emulsion directly enters the injection pipe, thus the risk points in the production process and the online explosive material storage amount are reduced, and the intrinsic safety of manufacturing and encapsulating the explosive is achieved.

BRIEF DESCRIPTION OF THE DRAWINGS

1.

1: oil phase inlet
2: water phase inlet
3: shell
4: core

5: outlet

Figure 3:
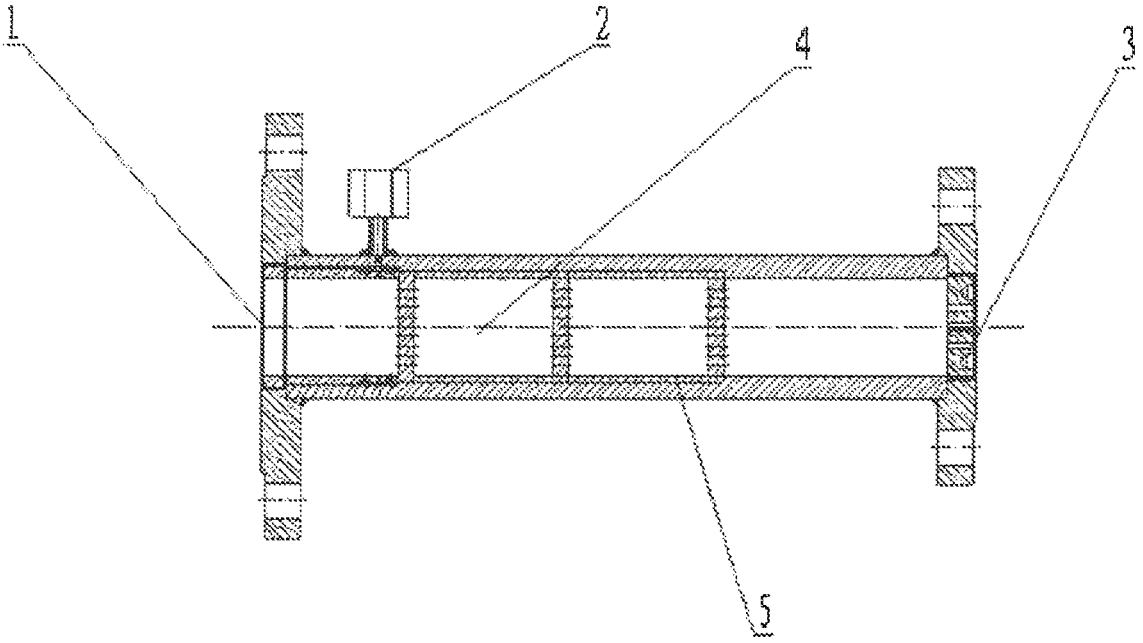

3. FIG. 3 is a static sensitization device of the present invention.

1: material inlet

2: sensitizer charging inlet

3: material outlet (fine emulsification orifice plate)

4: core

5: shell

Figure 4:
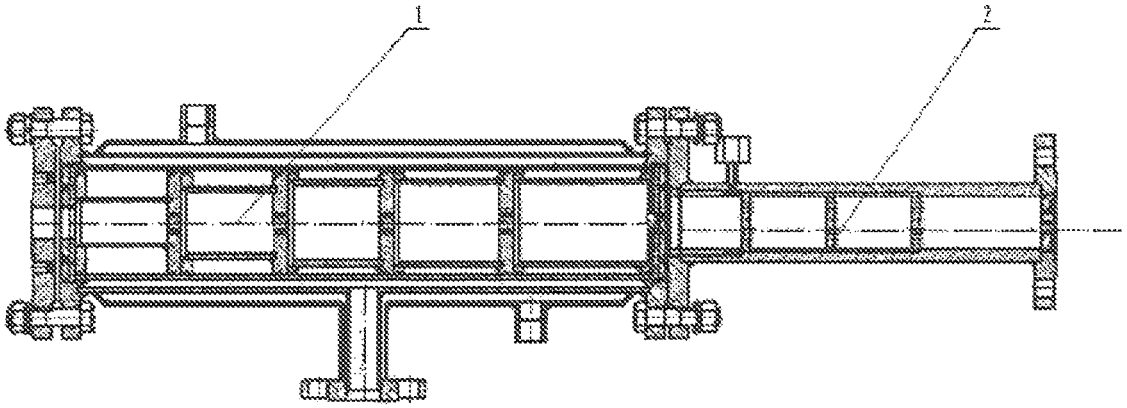

4. FIG. 4 is a schematic diagram of a combination of static emulsification and static sensitization of the present invention.

1: static emulsifier

2: static sensitization device (can be with static fine emulsification)

DETAILED DESCRIPTION OF EMBODIMENTS

Figure 1:
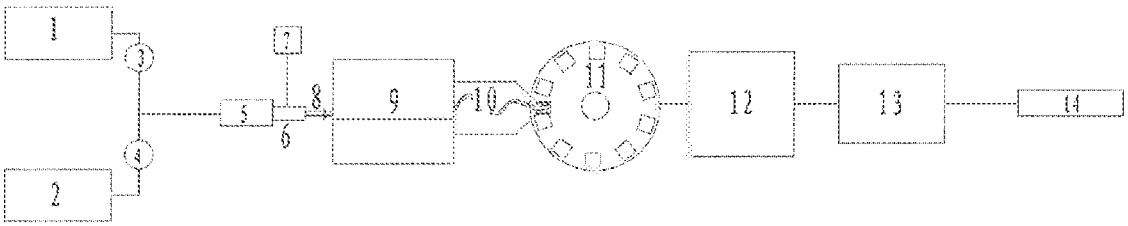
FIG. 1 is a process flow diagram of a method of the present invention.
2.
Figure 2:
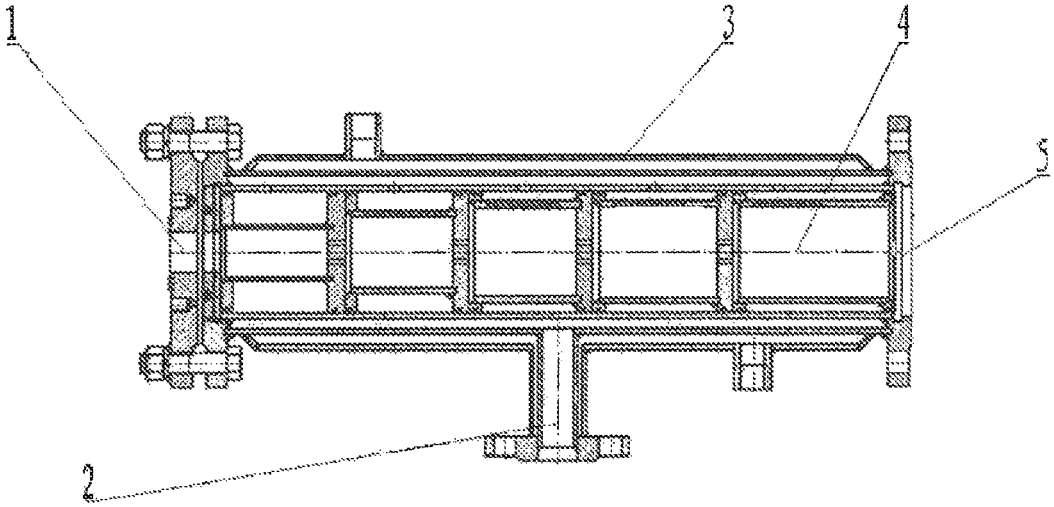
FIG. 2 is a static emulsifier of the present invention.

Please refer to FIG. 2, 5-stage emulsification is performed with a 5-stage emulsifier; the total-proportion of oil phase enters the start of the static emulsifier, and a first proportion of water phase from a first diverging port was sprayed out laterally at a certain speed through a first injector hole. The water phase hit against the oil phase, and their mixture goes through a first orifice plate, sprays out at a certain speed, and becomes a first coarse emulsion. The spray runs into and mixes with a second proportion of water phase running at a certain speed from a second injector hole, and their mixture goes through a second orifice plate, sprays out at certain speed, and becomes a second coarse emulsion. The spray runs into and mixes with a third proportion of water phase running at a certain speed from a third injector hole, and their mixture goes through a third orifice plate, sprays out at certain speed, and becomes a third coarse emulsion. The spray runs into and mixes with a fourth proportion of water phase running at a certain speed from a fourth injector hole, and their mixture goes through a fourth orifice plate, sprays out at certain speed, and becomes a fourth coarse emulsion. The spray runs into and mixes with a fifth proportion of water phase running at a certain speed from a fifth injector hole, and their mixture goes through a fifth orifice plate, sprays out at certain speed, and becomes a fifth coarse emulsion. The spray runs through the fine emulsification orifice plate, sprays out at a certain speed, and the emulsification process is completed.

The emulsion matrix then enters the static sensitization device, meanwhile, the sensitizer enters an emulsion chamber through a sensitizer charging inlet, at a speed of no less than 1 m/s, by means of a sensitizer injector hole located on a primary core. The matrix mixes with the sensitizer when going through a primary multi-orifice plate, and then is mixed to uniformity by going through a second multi-orifice plate and a third multi-orifice plate and so on. After uniformed mixed, the emulsion runs through the last multi-orifice plate of the static sensitization device to be finely emulsified in a static state, and then the emulsion enters an injection pipe of a heat sealing machine, or the emulsion enters a normal injection pipe without being finely emulsified in a static state. The injection pipe is wrapped in a cylindrical film where the emulsion is evenly filled. It is better to put the filled explosive material roll in an S-shape on a buffer machine with the help of a winding mechanism (this step can be skipped). The clipping machines installed and rotated on a rotary platform are used to guide the explosive material rolls and to sequentially complete sealing, cutting and tossing of the plastic explosive material rolls (other universal clipping and sealing machines can also be adopted). The explosive material rolls are then cooled down in cooling water. After the explosive is cooled, it is boxed, and then it is stored in a warehouse.

For a better explanation of the present invention, the invention will be explained in details below by way of specific embodiments

Embodiment One

The oil phase from the oil tank enters the primary coarse emulsion mixer through the oil pump at its full ratio of the explosive; the water phase from the water tank enters the multi-stage coarse emulsion mixers for multiple times after multi-stage diverging at its ratios of the explosive, and finally, emulsification is completed through the last stage of the coarse emulsion mixers. The emulsion matrix has a density of 1.37 g/cm$^3$ as measured. The emulsion matrix then enters the static sensitization device, meanwhile, the sensitizer at a 0.3% dosage enters an emulsion chamber through a sensitizer charging inlet, at a speed of no less than 3 m/s, by means of a sensitizer injector hole located on a primary core. The emulsion matrix mixes with the sensitizer when going through a primary multi-orifice plate, and then is mixed to uniformity by going through a second multi-orifice plate and a third multi-orifice plate and so on. After the sensitization temperature reaches 80° C., the density of the explosive is measured to be 1.07 g/cm$^3$. The emulsion then enters an injection pipe of a heat sealing machine. The injection pipe is wrapped in a cylindrical film and uniform filling of the emulsion material in the cylindrical film is carried out by control of the heat sealing machine. The filled material roll is put in an S-shape on a buffer machine with the help of a winding mechanism. The clipping machines installed and rotated on a rotary platform are used to guide the explosive material rolls and to sequentially complete sealing, cutting and tossing of the plastic explosive material rolls. The explosive material rolls are then cooled down in cooling water. After the explosive is cooled, it is transported by a conveying belt and boxed, and then it is stored in a warehouse. The density of the explosive material roll at this point is 1.10 g/cm$^3$, and the explosive material temperature is 25° C.

Embodiment Two

The oil phase from the oil tank enters the primary coarse emulsion mixer through the oil pump at its full ratio of the explosive; the water phase from the water tank enters the multi-stage coarse emulsion mixers for multiple times after multi-stage diverging at its ratios of the explosive, and finally, emulsification is completed through the last stage of the coarse emulsion mixers. The emulsion matrix at this point has a density of 1.35 g/cm$^3$. The coarse emulsion matrix then enters the static sensitization device, meanwhile, the sensitizer at a 0.3% dosage enters an emulsion chamber through a sensitizer charging inlet, at a speed of no less than 3 m/s, by means of a sensitizer injector hole located on a primary core. The coarse emulsion matrix mixes with the sensitizer when going through a primary multi-orifice plate, and then is mixed to uniformity by going through a second multi-orifice plate and a third multi-orifice plate and so on. After uniformed mixed, the emulsion runs through the last multi-orifice plate of the static sensitization device to be finely emulsified in a static state, and then the density of explosive is measured to be 1.08 g/cm$^3$. The emulsion then enters an injection pipe of a heat sealing machine. The injection pipe is wrapped in a cylindrical film and uniform filling of the emulsion material in the cylindrical film is carried out by control of the heat sealing machine. The filled material roll is put in an S-shape on a buffer machine with the help of a winding mechanism. The clipping machines installed and rotated on a rotary platform are used to guide the material rolls and to sequentially complete sealing, cutting and tossing of the plastic explosive material rolls. The explosive material rolls are then cooled down in cooling water. After the explosive is cooled, it is transported by a conveying belt and boxed, and then it is stored in a warehouse. The density of the explosive material roll at this point is 1.10 g/cm$^3$, and the explosive material temperature is 25° C.

Embodiment Three

The oil phase from the oil tank enters the primary coarse emulsion mixer through the oil pump at its full ratio of the explosive; the water phase from the water tank enters the multi-stage coarse emulsion mixers for multiple times after multi-stage diverging at its ratios of the explosive, and finally, emulsification is completed through the last stage of the coarse emulsion mixers. The emulsion matrix at this point has a density of 1.35 g/cm$^3$. The emulsion colloid matrix then enters the static sensitization device, meanwhile, the sensitizer at a 0.3% dosage enters an emulsion chamber through a sensitizer charging inlet, at a speed of no less than 3 m/s, by means of a sensitizer injector hole located on a primary core. The coarse emulsion matrix mixes with the sensitizer in the static mixer, and then the density of explosive is measured to be 1.20 g/cm$^3$. The emulsion then enters an injection pipe of a heat sealing machine. The injection pipe is wrapped in a cylindrical film and uniform filling of the emulsion material in the cylindrical film is carried out by control of the heat sealing machine. The filled material roll is put in an S-shape on a buffer machine with the help of a winding mechanism. The clipping machines installed and rotated on a rotary platform are used to guide the material rolls and to sequentially complete sealing, cutting and tossing of the plastic explosive material rolls. The explosive material rolls are then cooled down in cooling water. After the explosive is cooled, it is transported by a conveying belt and boxed, and then it is stored in a warehouse. The density of the explosive material roll at this point is 1.10 g/cm$^3$, and the explosive material temperature is 25° C.

Apparently, the aforementioned embodiments are merely examples illustrated for clearly describing the present invention, rather than limiting the implementation ways thereof. For those skilled in the art, various changes and modifications in other different forms can be made on the basis of the aforementioned description. It is unnecessary and impossible to exhaustively list all the implementation ways herein. However, any obvious changes or modifications derived from the aforementioned description are intended to be embraced within the protection scope of the present invention.

The invention claimed is:

1. A method for continuously producing emulsion explosive by emulsification and sensitization in a static state without a loading pump, including emulsification, sensitization, encapsulation, the method comprising:

providing a static emulsification device that is a first jet flow device;

providing a static sensitization device that is a second jet flow device, the static sensitization device including: a shell, a sensitizer charging inlet, at least three cores, and a plurality of multi-orifice plates having round orifices;

performing a continuous process of static emulsification and static sensitization to produce a sensitized explosive material, the static sensitization device being configured to carry out the static sensitization by:

providing the sensitizer through the sensitizer charging inlet, entering the sensitizer into a primary core via a sensitizer injector hole located on the primary core, mixing the emulsion with the sensitizer by passing the emulsion and sensitizer through a primary multi-orifice plate, and further mixing the emulsion and sensitizer mixture to uniformity by passing the emulsion and sensitizer mixture through a second multi-orifice plate and a third multi-orifice plate; and directly entering the sensitized explosive directly into a encapsulation process for encapsulation.

2. The method according to claim 1, wherein the static emulsification device includes an oil phase inlet, a water phase inlet, a shell and a plurality of cores, the shell has diverging ports on its inner wall, and each of the plurality of cores includes an injector hole and an orifice plate.

3. The method according to claim 2, wherein each of the cores corresponds to one of the diverging ports where water phase flows into the corresponding core.

4. The method according to claim 2, wherein the injector hole is located on a tube wall of the core and the orifice plate is located at a rear end of the core, a water phase is configured to flow through the diverging port and then enter the core through the injector hole, and after being mixed for emulsification with oil phase entering from the oil phase inlet, the resulting emulsion enters the next core through the orifice plate.

5. The method according to claim 2, wherein the static emulsification device includes five cores.

6. The method according to claim 1, wherein the static emulsification and static sensitization are carried out by static coarse emulsification, static sensitization and static fine emulsification in sequence, and the static sensitization and the static fine emulsification utilize the same device.

7. The method according to claim 1, wherein the emulsification device and sensitization device are directly connected to an injection pipe.

8. The method according to claim 3, wherein the static emulsification device includes five cores.

* * * * *